United States Patent [19]

van Klinken et al.

[11] 4,039,429

[45] Aug. 2, 1977

[54] PROCESS FOR HYDROCARBON CONVERSION

[75] Inventors: Jakob van Klinken; Peter Ladeur, both of Amsterdam, Netherlands

[73] Assignee: Shell Oil Company, Houston, Tex.

[21] Appl. No.: 697,183

[22] Filed: June 17, 1976

[30] Foreign Application Priority Data

June 23, 1975 Netherlands ..... 7507484

[51] Int. Cl.[2] ..... C10G 37/04; C10G 37/06

[52] U.S. Cl. ..... 208/50; 208/61; 208/80; 208/86; 208/93

[58] Field of Search ..... 208/68, 80, 93, 50, 208/61

[56] References Cited

U.S. PATENT DOCUMENTS

| | | | |
|---|---|---|---|
| 3,281,350 | 10/1966 | Codet et al. | 208/80 |
| 3,671,419 | 6/1972 | Ireland et al. | 208/93 |
| 3,775,293 | 11/1973 | Watkins | 208/80 |

*Primary Examiner*—Herbert Levine

*Attorney, Agent, or Firm*—Ronald R. Reper

[57] ABSTRACT

Residual hydrocarbons stocks obtained after atmospheric distillation are converted into light distillates by certain sequences of processing steps including catalytic cracking, high and low pressure catalytic hydrotreatment, deasphalting, gasification and thermal cracking or coking.

11 Claims, 6 Drawing Figures

PROCESS FOR HYDROCARBON CONVERSION

BACKGROUND OF THE INVENTION

The invention relates to a process for the production of one or more light hydrocarbon oil distillates from a hydrocarbon oil residue obtained by atmospheric distillation.

During the atmospheric distillation of crude oil, as employed on a large scale in the refineries for the production of light hydrocarbon oil distillates, a residual oil is obtained as a by-product. In some cases this residual oil is suitable to serve as base i.e. starting material for the production of lubricating oil, but often the residual oil, which as a rule contains considerable quantities of sulfur, metals and asphaltenes, only qualifies for use as fuel oil.

In view of the growing need for light hydrocarbon oil distillates various processes have been proposed over the years which aimed at the conversion of the residual oils into light distillates. Exemplary processes include catalytic cracking, thermal cracking, gasification in combination with hydrocarbon synthesis, coking and hydrocracking. The use of the residual oils as such as feed for each of these processes has considerable disadvantages, which seriously hamper their application on a commercial scale. For instance, the catalytic cracking of these residual oils has the serious drawbacks that catalyst consumption is very high and that owing to the high coke and gas production only a low yield of the desired light distillates is obtained. The thermal cracking of these residual oils for the production of light distillates is not attractive either, because the stability of the cracked product permits only a low conversion to desired light distillates. Coking of the residual oils yields a considerable quantity of coke as product and this coke production occurs at the expense of the yield of desired light distillates. Gasification of the residual oils in combination with hydrocarbon synthesis is rather expensive and moreover not very attractive because in this way first the too heavy molecules are cracked to form too light molecules, the latter subsequently being recombined to form heavier ones. The hydrocracking of the residual oils is accompanied by a rapid catalyst deactivation and/or a high production and/or a high consumption of hydrogen.

In view of the above and taking into account the fact that in the atmospheric distillation of crude oil about half of the crude oil is left behind as distillation residue, it will be clear that there is a pressing need for a process which offers the possibility of converting in an economically justifiable way hydrocarbon oil residues obtained by atmospheric distillation into light, i.e. low boiling hydrocarbon oil distillates such as gasolines.

As in practice catalytic cracking has proved to be an excellent process for the conversion of heavy hydrocarbon oil distillates such as gas oils into light hydrocarbon oil distillates such as gasolines, the applicants have carried out an investigation in order to find out what use could be made of catalytic cracking for the conversion of hydrocarbon oil residues obtained by atmospheric distillation. It has been found that in a certain combination of catalytic cracking with catalytic high-pressure hydrotreatment, catalytic low-pressure hydrotreatment, deasphalting, gasification and thermal cracking or coking, a process can be realized which is highly suitable for this purpose. The present patent application relates to such a process.

SUMMARY OF THE INVENTION

According to the invention there is provided a process for the production of light hydrocarbon distillates from a hydrocarbon oil residue obtained by atmospheric distillation which comprises a. fractionating said residue by vacuum distillation into a vacuum distillate and a vacuum residue, b. deasphalting said vacuum residue in a deasphalting zone by contact with a low boiling hydrocarbon sorbent to obtain a deasphalted oil and asphalt, c. catalytically cracking said vacuum distillate and said deasphalted oil in a catalytic cracking zone to obtain a catalytically cracked product, d. fractionating said catalytically cracked product by fractionation distillation at essentially atmospheric pressure to obtain at least one light hydrocarbon distillate product, and intermediate boiling fraction and a residue;

e. hydrotreating said intermediate boiling fraction in a low pressure hydrotreating zone and recycling at least part of said intermediate fraction to said catalytic cracking zone;

f. thermally heating at least one of said asphalt and said residue in thermal treatment zone selected from a thermal cracking zone and a coking zone to obtain a thermal treatment product;

g. fractionating said thermal product by fractionation distillation into at least one light distillate product, a thermal intermediate fraction and a thermal residue;

h. hydrotreating said thermal intermediate fraction in a low pressure hydrotreating zone and recycling at least part of this hydrotreated product as feed to the catalytic cracking zone;

i. gasifying the thermal residual fraction in a gasification zone and catalytically reacting said gasified product with steam to produce hydrogen;

j. feeding said hydrogen to a high pressure catalytic hydrotreating zone together with at least part of the atmospheric distillation residue feed prior to step (a) or to at least part of the vacuum residue feed to step (b); then k. passing said hydrogen exiting said high pressure hydrotreating zone as feed to a low pressure catalytic hydrotreating zone together with a feed selected from the vacuum distillate product of step (a) and at least part of the asphalt product of step (b); and then l. passing said hydrogen exiting step (k) to at least one low pressure catalytic hydrotreating zone selected from steps (e) and (h).

DESCRIPTION OF PREFERRED EMBODIMENTS

Figure 1:
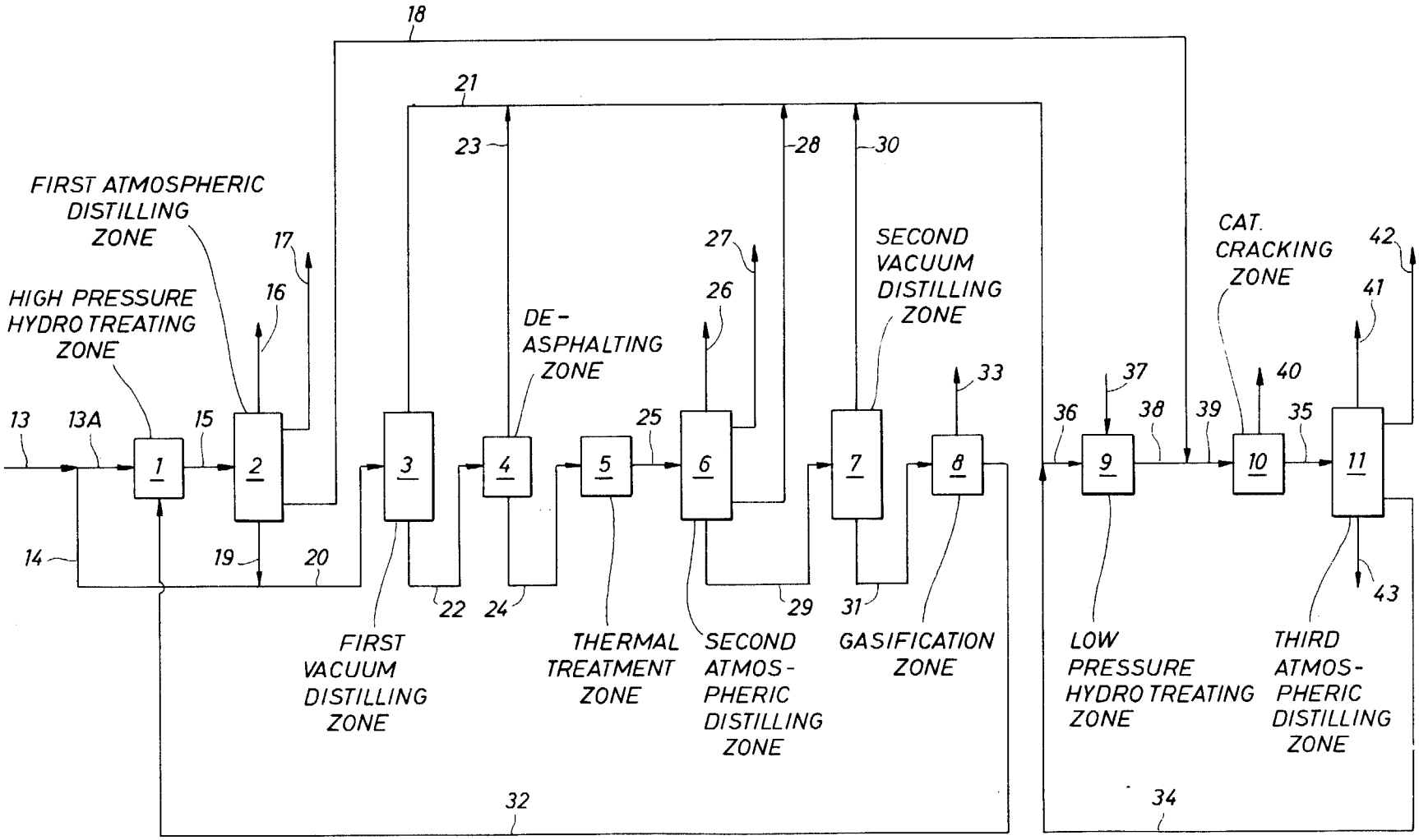
FIGS. 1 to 6 each illustrates different embodiments of the processing scheme according to the invention.

In the process according to the invention a hydrocarbon oil residue obtained by atmospheric distillation (AR) and/or an atmospheric residue obtained therefrom by catalytic high-pressure hydrotreatment and distillation of the hydrotreated product, is split, by vacuum distillation, into a vacuum distillate (VD) and a vacuum residue (VR). The vacuum residue and/or a vacuum residue obtained therefrom by catalytic high-pressure hydrotreatment and distillation of the hydrotreated product, is split, by deasphalting, into a deasphalted oil and asphalt. The deasphalted oil and the vacuum distillate (VD) are cracked catalytically and the cracked product is separated by atmospheric distillation into one or more light distillates as end-products, an intermediate fraction of which at least a part is again cracked catalytically after a catalytic low-pressure hydrotreatment, and a residue. The asphalt and/or a vacuum residue or asphalt fraction obtained therefrom by catalytic high-pressure hydrotreatment and distillation or deashphalting, respectively, of the hydrotreated product, is subjected to thermal cracking or coking and the product so obtained is split by distillation into one or more light distillates as end products, an intermediate fraction which after a catalytic low-pressure hydrotreatment is cracked catalytically and a residual fraction which is gasified for the production of hydrogen for the catalytic high-pressure hyrdotreatment. The last-mentioned hydrotreatment is applied either to at least part of the atmospheric distillation residue (AR), or to at least part of the vacuum residue (VR) and is then combined with a catalytic low-pressure hydrotreatment of the vacuum distillate (VD), or to at least part of the asphalt from the vacuum residue (VR) by deasphalting and is then combined with a catalytic low-pressure hydrotreatment of both the vacuum distillate (VD) and the deasphalted oil.

In the process according to the invention catalytic cracking constitutes the main process. In the catalytic cracking operation a considerable part of the heavy feed is convered into desired light distillates. The cracked product is split by atmospheric distillation into one or more light distillates as end-products, an intermediate fraction of which at least a part is again cracked catalytically after a catalytic low-pressure hydrotreatment, and a residue. Preferably more than 50%*w* of the intermediate fraction is subjected to a catalytic low-pressure hydrotreatment followed by catalytic cracking. During catalytic cracking, which is preferably carried out in the presence of a zeolite catalyst, coke is deposited on the catalyst. This coke is removed from the catalyst by burning off during a catalyst regeneration that is combined with the catalytic cracking operation, which produces a waste gas consisting substantially of a mixture of carbon monoxide and carbon dioxide. The catalytic cracking operation is preferably carried out at a temperature of from 400° to 550° C, a pressure of from 1 to 10 bar, a space velocity of from 0.25 to 4 kg feed per kg of catalyst per hour and a catalyst changing rate of from 0.1 to 5 tons of catalyst per 1000 tons of feed. Specially preferred conditions for carrying out the catalytic cracking operation include temperatures from about 450° to 525° C, pressures from about 1.5 to 7.5 bar, space velocities from about 0.5 to 2.5 $kg.kg^{-1}.hour^{-1}$ and catalyst changing rates from about 0.2 to 2 tons of catalyst per 1000 tons of feed.

In the process according to the invention both a catalytic high-pressure and a catalytic low-pressure hydrotreatment are employed as supplementary processes. The two processes differ from each other primarily in that the hydrogen partial pressure employed in the high-pressure treatment is always at least 25 bar higher than the one applied by the low-pressure treatment. Preferably the difference between the two hydrogen partial pressures amounts to at least 50 bar. The catalytic high-pressure hydrotreatment employed in the process is preferably carried out at a temperature of from 325° to 500° C, a hydrogen partial pressure of from 75 to 250 bar, a space velocity of from 0.1 to 2.5 l feed per catalyst per hour and a hydrogen/feed ratio of from 250–3000 Nl/kg. Special preference exists for carrying out the catalytic high-pressure hydrotreatment at temperatures from about 350° to 475° C, hydrogen partial pressures from about 90 to 175 bar, space velocities from about 0.15 to 1.5 $l.l^{116}.hour^{-1}$ and hydrogen/feed retios from 500 to 2000 Nl/kg. The catalytic low-pressure hydrotreatment employed in the process aims mainly at reducing the metal content of the feed for the catalytic cracking unit and thereby limiting the catalyst consumption in the cracking unit and further aims at saturating the feed for the catalytic cracking unit with hydrogen and thereby reducing coke deposition on the cracking catalyst and increasing the yield of desired product. The catalytic low-pressure hydrotreatment is preferably carried out at a temperature of from 275° to 425° C, a hydrogen partial pressure of 20 to 75 bar, a space velocity of from 0.1 to 5 l feed per l of catalyst per hour and a hydrogen/feed ratio of from 100 to 2000 Nl/kg. Specially preferred conditions for carrying out the catalytic low-pressure hydrotreatment includes temperatures from about 300° to 400° C, hydrogen partial pressures from about 25 to 60 bar, space velocities from about 0.2 to 3 $l.l^{-1}-1$ and hydrogen/feed ratios from about 200 to 1500 Nl/kg. Both in the high-pressure and in the low-pressure hydrotreatment preferably a sulfided catalyst is used which contains nickel and/or cobalt and in addition molybdenum and/or tungsten on alumina, silica or silica-alumina as the carrier.

In the process according to the invention it is usual for the product obtained by catalytic high-pressure hydrotreatment to be subjected in succession to an atmospheric and to a vacuum distillation. This yields one or more light distillates as end-products, one or more heavier distillates as feed for the catalytic cracking unit and a vacuum residue. If the catalytic high-pressure hydrotreatment is applied to asphalt the above-mentioned vacuum distillation of the atmospheric residue from the hydrotreated product may very suitably be replaced by deasphalting. The deasphalted oil obtained upon deasphalting of the atmospheric residue is used as a feed component for the catalytic cracking unit and the asphalt is subjected to thermal cracking or coking.

The process according to the invention further comprises a thermal cracking or coking step whereby a considerable proportion of the residual feed is converted into distillate. From this distillate a small quantity of light distillate can be isolated as end-product; however, it consists substantially of heavier distillate which after a catalytic low-pressure hydrotreatment is suitable to serve as a feed component for the catalytic cracking unit. The residual fraction which is left behind after working up of the product obtained by thermal cracking or coking, serves as feed for the gasification zone. If in the process according to the invention thermal cracking is applied, this is preferably carried out at a temperature of from 400° to 525° C, a pressure of from 2.5 to 25 bar and a residence time of from 1 to 25 minutes. Special preference exists for carrying out the thermal cracking at a temperature of from 425° to 500° C, a pressure of from 5 to 20 bar and a residence time of from 5 to 20 minutes. If in the process according to the invention coking is employed, this is preferably carried out at a temperature of from 400° to 600° C, a pressure of from 1 to 25 and a residence time of from 5 to 50 hours. Special preference exists for carrying out the coking at a temperature of from 425° to 550° C, a pressure of from 2.5 to 20 bar and a residence time of from 10 to 40 hours.

Finally, the process according to the invention comprises gasification as a supplementary process. As feed for the gasification unit the residual fraction is used which is left behind after working up of the product obtained by thermal cracking or coking. The gasification is carried out by incomplete combustion of the feed with oxygen. Preferably steam is added to the mixture as moderator. In the incomplete combustion a crude gas is obtained consisting substantially of carbon monoxide and hydrogen and containing a considerable quantity of sulfur. The hydrogen content of this crude is increased by subjecting it to the water gas shift reaction in which carbon monoxide is converted into carbon dioxide and hydrogen by reaction with steam. The water gas shift reaction is preferably carried out by passing the gas to be converted at a temperature of between 325° and 400° C through two or more reactors containing a high-temperature water gas shift catalyst and subsequently passing the partly converted gas mixture at a temperature of between 200° and 275° C through a reactor containing a low-temperature water gas shift catalyst. As high-temperature water gas shift catalysts iron-chromium catalysts are very suitable. Effective low-temperature water gas shift catalyst are copper-zinc catalysts. Each of the high- and low-temperature catalysts are preferably supported on a porous carrier such as alumina. In view of the rapid contamination of the catalysts by soot, this must, at least when use is made of conventional reactors, be removed from the gas before it is subjected to the catalytic water gas shift reaction. If use is made of sulfur-sensitive catalysts, such as the above-mentioned iron-chromium and copper-zinc catalysts, sulfur must also be removed from the gas before it is subjected to the catalytic water gas shift reaction. Removal of the sulfur from the crude gas may be omitted if use is made of sulfur-insensitive catalysts such as the $Ni/Mo/Al_2O_3$ or $Co/Mo/Al_2O_3$ catalysts according to Dutch application 7394793 or the $Ni/Mo/Al/Al_2O_3$ or $Co/Mo/Al/Al_2O_3$ catalysts according to Dutch patent application 7305304. The water gas shift reaction is preferably carried out at a pressure of between 10 and 100 bar and in particular between 20 and 80 bar. The quantity of steam which is present in the gas mixture that is subjected to the water gas shift reaction preferably amounts to 1–50 mol per mol carbon monoxide. After completion of the water gas shift reaction hydrogen-rich gas still has to be purified so as to obtain pure hydrogen. Insofar as removal of soot and sulfur has not already been effected prior to the water gas shift reaction, it has to take place now. The purification of the hydrogen-rich gas further comprises, inter alia, the removal of the carbon dioxide formed and of unconverted carbon monoxide.

The hydrogen which in the process according to the invention is produced by gasification is primarily intended for use in the catalytic high-pressure hydrotreatment. The process is preferably carried out in such a way that the quantity of hydrogen produced by gasification is at least sufficient to satisfy fully the hydrogen requirement of the catalytic high-pressure hydrotreatment. If the gasification yields more hydrogen than is needed for the catalytic high-pressure hydrotreatment, the extra quantity of hydrogen may be used in the catalytic low-pressure hydrotreatment or be used for an application beyond the scope of the process. The quantity of hydrogen obtained in the gasification is determined mainly by the quantity of feed which is supplied to the gasification section. The latter quantity can to a certain extent be controlled by variation of the conditions under which the catalytic high-pressure hydrotreatment, the deasphalting and the thermal cracking or coking are carried out. More effective means of controlling the quantity of feed which is offered to the gasification section are:

a. The use of part of the intermediate fraction and/or at least part of the residue from the catalytically cracked product as a feed component for the thermal cracking, coking or gasification, b. a repeated catalytic high-pressure hydrotreatment of a heavy fraction of the product which has already undergone such a treatment, c. application of the catalytic high-pressure hydrotreatment to only a part of the eligible material instead of to all the material concerned and d. combinations of the measures mentioned under (a)–(c).

The present invention comprises a number of attractive variants using the measures mentioned under (a)–(c) above. These variants will be described briefly below and will partly be discussed in more detail by reference to the accompanying drawings.

Variant a): As described hereinbefore, the product obtained by catalytic cracking is split by atmospheric distillation into one or more light distillate fractions as end-products, an intermediate fraction of which at least a part, after a catalytic low-pressure hydrotreatment, is subjected once more to catalytic cracking, and a residual fraction. According to variant a part of the intermediate fraction and/or at least part of the residue is employed as a feed component for the coker and/or gasification unit, and/or part of the intermediate fraction is employed as a feed component for the thermal cracker.

Variant b): As described hereinbefore, the catalytic high-pressure hydrotreatment is applied either to the atmospheric distillation residue that serves as feed for the process, or to the vacuum obtained therefrom by vacuum residue by deasphalting. According to variant b a part but less than 50%*w* of the atmospheric distillation residue or of the vacuum distillation residue or of the asphalt which is obtained upon splitting the hydrotreated product, is subjected once more to a catalytic high-pressure hydrotreatment.

variant c): With this variant only a part, but more than 50%*w*, of the atmospheric distillation residue which serves as feed for the process, or of the vacuum residue obtained therefrom by vacuum distillation, or of the asphalt obtained from the vacuum residue by deasphalting is subjected to high-pressure catalytic hydrotreatment, the remainder being mixed with the hydrotreated product. When carrying out the process according to variant c it should be borne in mind that a number of the fractions eligible as feed for the catalytic cracking section contain components not previously subjected to a catlytic hydrotreatment. These fractions must therefore be subjected to a catalytic low-pressure hydrotreatment prior to the catalytic cracking. Since in each of the three embodiments of the process according to the invention briefly described hereinbefore under variant c the asphalt and/or vacuum residue obtained therefrom by catalytic high-pressure hydrotreatment and distillation of the hydrotreated product may be converted by thermal cracking or coking, these three embodiments correspond with six process schemes. These six process schemes will be explained in more detail below by reference to the accompanying drawings.

Process Scheme I (FIG. 1)

The process is carried out in a plant which comprises a catalytic high-pressure hydrotreating zone 1, the first atmospheric distillation zone 2, the first vacuum distillation zone 3, a deasphalting zone 4, a thermal cracking zone 5, the second atmospheric distillation zone 6, the second vacuum distillation zone 7, a gasification zone 8, a catalytic low-pressure hydrotreating zone 9, a catalytic cracking zone 10 and the third atmospheric distillation zone 11. A hydrocarbon oil residue 13 obtained by atmospheric distillation is divided into two portions 13A and 14. Residue portion 13A is subjected to a catalytic high-pressure hydrotreatment and the hydrotreated product 15 is split, by atmospheric distillation, into a $C_4^-$ fraction 16, a gasoline fraction 17, a middle distillate fraction 18 and a residue 19. The residue 19 is mixed with portion 14 of the atmospheric residue and the mixture 20 is split by vacuum distillation into a vacuum distillate 21 and a residue 22. The residue 22 is split by deasphalting into a deasphalted oil 23 and an asphalt 24. The asphalt 24 is thermally cracked and the thermally cracked product 25 is split by atmospheric distillation into a $C_4^-$ fraction 26, a gasoline fraction 27, a middle distillate fraction 28 and a residue 29. The residue 29 is split by vacuum distillation into a vacuum distillate 30 and a residue 31. The residue 31 is gasified and the gas obtained is converted, by means of the water gas shift reaction and purification, into hydrogen 32 which is fed to the catalytic high-pressure hydrotreating unit and a waste gas 33 which substantially consists of carbon dioxide. The vacuum distillate 21, the deasphalted oil 23, the middle distillate fraction 28 and the vacuum distillate 30 are mixed with a middle distillate fraction 34, which is obtained by atmospheric distillation from the catalytically cracked product 35 still to be discussed, and the mixture 36, together with a hydrogen stream supplied 37, is subjected to a catalytic low-pressure hydrotreatment. The hydrotreated product 38 is mixed with the middle distillate fraction 18 and the mixture 39 is cracked catalytically. In the regeneration of the catalyst in the catalytic cracking unit a waste gas 40 is obtained which consists substantially of a mixture of carbon monoxide are carbon dioxide. The catalytically cracked product 35 is split by atmospheric distillation into a $C_4^-$ fraction 41, a gasoline fraction 42 and a middle distillate fraction 34 and a residue 43.

Figure 2:
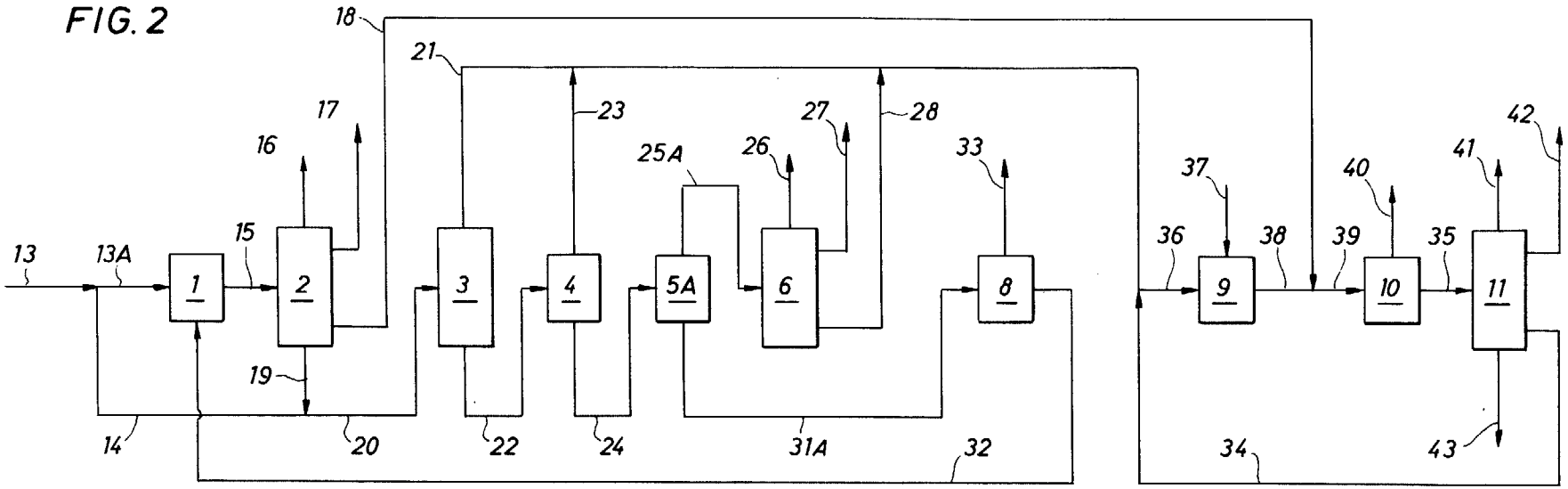

Process Scheme II (FIG. 2)

The process is carried out in a plant substantially like the one described under process scheme I and wherein the same numbers have the same meaning, the differences being that now instead of the thermal cracking zone 5, a coking zone 5A is present and that the second vacuum distillation zone 7 is omitted. The processing of the hydrocarbon oil residue 13A obtained by atmospheric distillation takes place in substantially the same way as described under process scheme I, the differences being that now instead of thermal cracking of the asphalt 24, coking of the asphalt is carried out to form a distillate 25A and coke 31A and that now instead of the vacuum residue 31 from the thermally cracked product, the coke 31A is employed as feed for the gasification zone.

Figure 3:
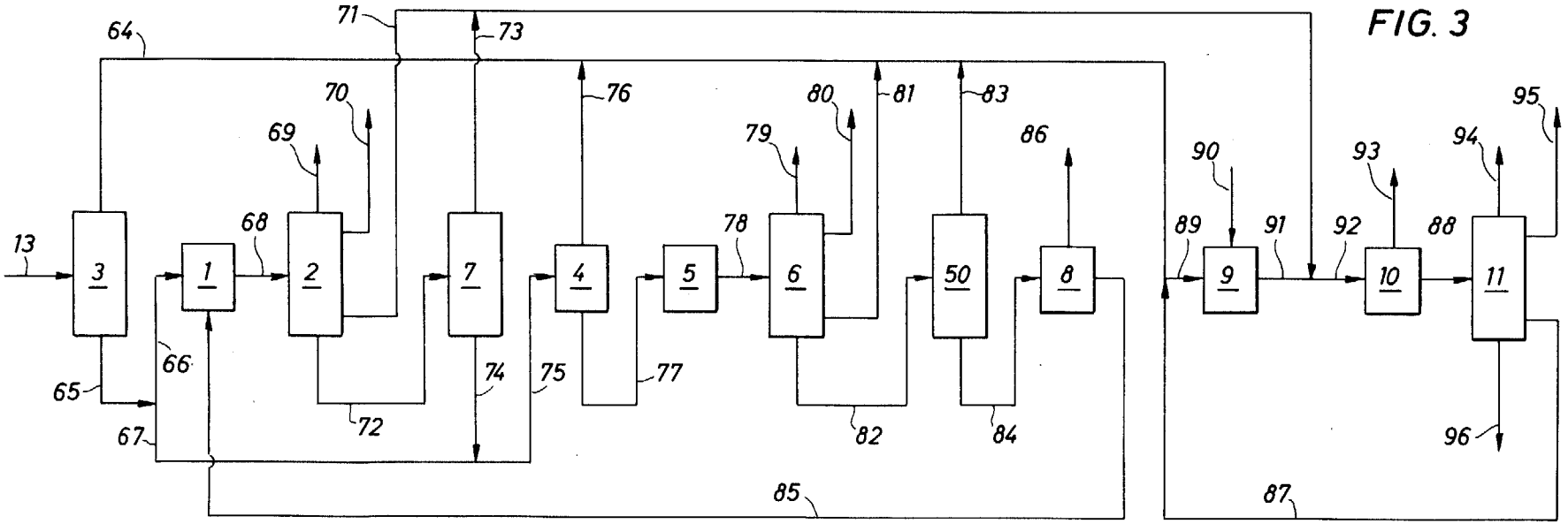

Process Scheme III (FIG. 3)

The process is carried out in a plant which comprises the first vacuum distillation zone 3, a catalytic high-pressure hydrotreating zone 1, the first atmospheric distillation zone 2, the second vacuum distillation zone 7, a deasphalting zone 4, a thermal cracking zone 5, the second atmospheric distillation zone 6, the third vacuum distillation zone 50, a gasification zone 8, a catalytic low-pressure hydrotreating zone 9, a catalytic cracking zone 10 and the third atmospheric distillation zone 11. A hydrocarbon oil residue 13 obtained by atmospheric distillation is split by vacuum distillation into a vacuum distillate 64 and a vacuum residue 65. The vacuum residue 65 is divided into two portions 66 and 67. Portion 66 is subjected to a catalytic high-pressure hydrotreatment and the hydrotreated product 68 is split by atmospheric distillation into a $C_4^-$ fraction 69, a gasoline fraction 70, a middle distillate fraction 71 and a residue 72. The residue 72 is split by vacuum distillation into a vacuum distillate 73 and a residue 74. The residue 74 is mixed with portion 67 of the vacuum residue and the mixture 75 is split by deasphalting into a deasphalted oil 76 and an asphalt 77. The asphalt 77 is thermally cracked and the thermally cracked product 78 is split by attmospheric distillation into a $C_4^-$ fraction 79, a gasoline fraction 80, a middle distillate fraction 81 and a residue 82. The residue 82 is split by vacuum distillation into a vacuum distillate 83 and a residue 84. The residue 84 is gasified and the gas obtained is converted by means of the water gas shift reaction and purification into hydrogen 85 which is fed to the catalytic high-pressure hydrotreating unit and a waste gas 86 which substantially consists of carbon dioxide. The vacuum distillate 64, the deasphalted oil 76, the middle distillate fraction 71, the deasphalted oil 76, the middle distillate fraction 81 and the vacuum distillate 83 and are mixed with a middle distillate fraction 87, which is obtained by atmospheric distillation from the catalytically cracked product 88 still to be discussed, and the mixture 89, together with a hydrogen stream supplied 90, is subjected to a catalytic low-pressure hydrotreatment in zone 9. The hydrotreated product 91 is mixed with the middle distillate fraction 71 and the vacuum distillate 73 and the mixture 92 is cracked catalytically in catalytic cracking zone 10. In the regeneration of the catalyst in the catalytic cracking unit a waste gas 93 is obtained which substantially consists of a mixture of carbon monoxide and carbon dioxide. The catalytically cracked product 88 is split by atmospheric distillation in zone 11 into a $C_4^-$ fraction 94, a gasoline fraction 95, a middle distillate fraction 87 and a residue 96.

Process Scheme IV

Figure 4:
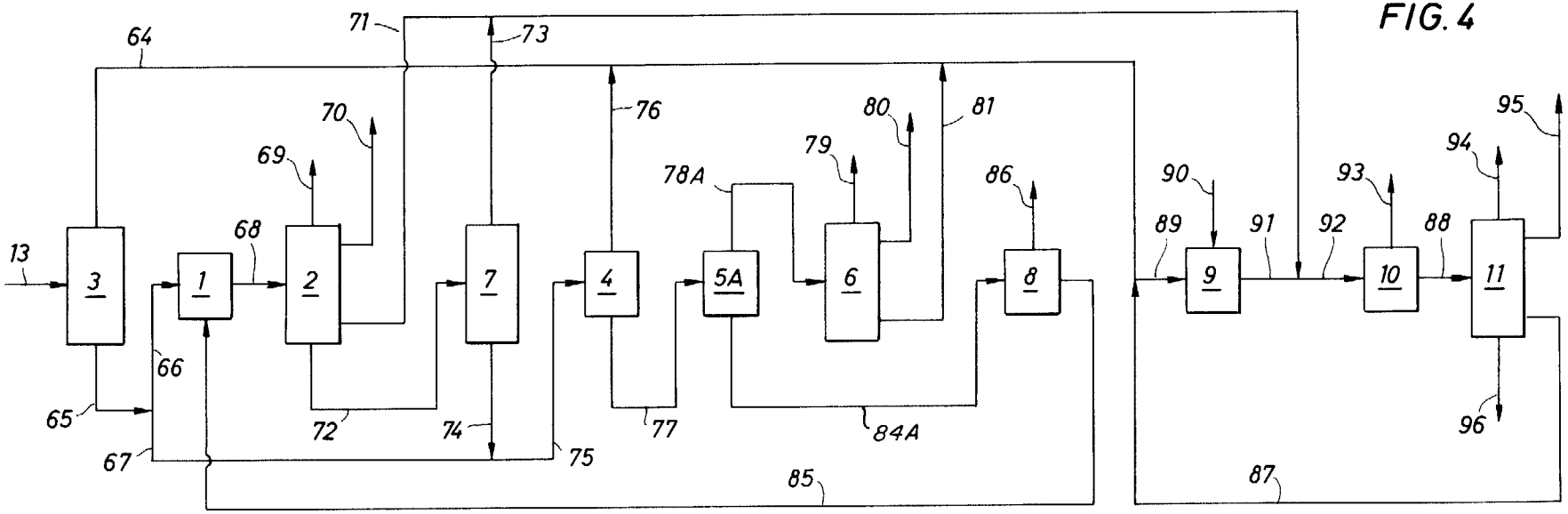

The process is carried out in a plant (FIG. 4) which is substantially equal to the one described under process scheme III and in which the same numbers have the same meaning, the differences being that now instead of the thermal cracking unit 5, a coking unit 5A is present and that the third vacuum distillation unit 50 is omitted. The processing of the hydrocarbon oil residue 13 obtained by atmospheric distillation takes place in substantially the same way as described under process scheme III, the differences being that now instead of thermal cracking of the asphalt 77, coking of the asphalt is carried out to form a distillate 78A and coke 84A and that now instead of the vacuum residue 84 from the thermally cracked product, the coke 84A is employed as feed for the gasification unit.

Process Scheme V

Figure 5:
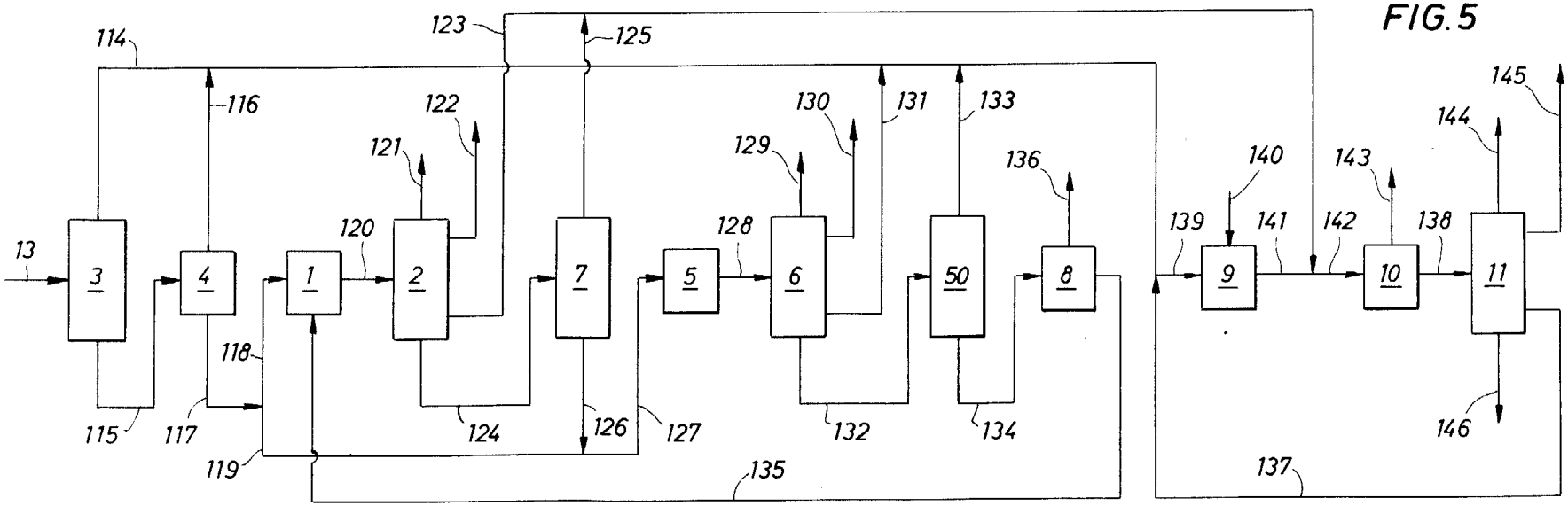

The process is carried out in a plant (FIG. 5) which comprises the first vacuum distillation zone 3, a deasphalting zone 4, a catalytic high-pressure hydrotreating zone 1, the first atmospheric distillation zone 2, the second vacuum distillation zone 7, a thermal cracking zone 5, the second atmospheric distillation unit 6, the third vacuum distillation unit 50, a gasification unit 8, a catalytic low-pressure hydrotreating unit 9, a catalytic cracking unit 10 and the third atmospheric distillation unit 11. A hydrocarbon oil residue 13 obtained by atmospheric distillation is split by vacuum distillation into a vacuum distillate 114 and a residue 115. The residue 115 is split by deasphalting into a deasphalted oil 116 and an asphalt 117. The asphalt 117 is divided into two portions 118 and 119. Portion 118 is subjected to a catalytic high-pressure hydrotreatment in zone 1 and the hydrotreated product 120 is split by atmospheric distillation into a $C_4^-$ fraction and a residue 124. The residue 124 is split by vacuum distillation into a vacuum distillate 125 and residue 126. The residue 126 is mixed with portion 119 of the asphalt and the mixture 127 is thermally cracked. The thermally cracked product 128 is split by atmospheric distillation into a $C_4^-$ fraction 129, a gasoline fraction 130, a middle distillate fraction 131 and a residue 132. The residue 132 is split by vacuum distillation into a vacuum distillate 133 and a residue 134. The residue 134 is gasified and the gas obtained is converted by means of the water gas shift reaction and purification into hydrogen 135 which is fed to the catalytic high-pressure hydrotreating unit and a waste gas 136 which substantially consists of carbon dioxide. The vacuum distillate 114, the deasphalted oil 116, the middle distillate 131 and the vacuum distillate 133 are mixed with a middle distillate fraction 137, which is obtained by atmospheric distillation from the catalytically cracked product 138 still to be discussed and the mixture 139, together with a hydrogen stream supplied 140, is subjected to a catalytic low-pressure hydrotreatment. The hydrotreated product 141 is mixed with the middle distillate fraction 128 and the vacuum distillate 125 and the mixture 142 is cracked catalytically. In the regeneration of the catalyst in the catalytic cracking unit a waste gas 143 is obtained which substantially consists of a mixture of carbon monoxide and carbon dioxide. The catalytically cracked product 138 is split by atmospheric distillation into a $C_4^-$ fraction 144, a gasoline fraction 145, a middle distillate fraction 137 and a residue 146.

Process Scheme VI

Figure 6:
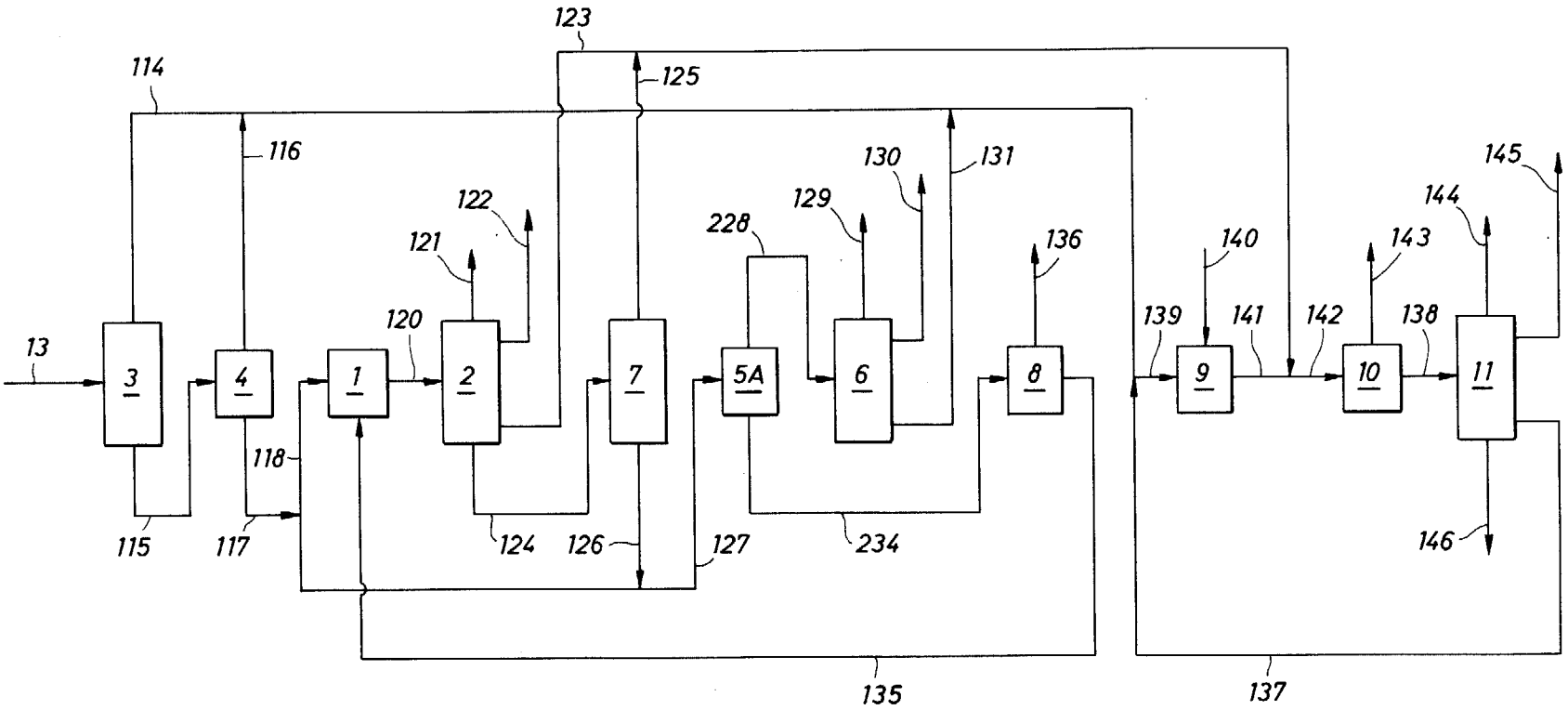

The process is carried out in a plant (FIG. 6) which is substantially equal to the one described under process scheme V and in which the same numbers have the same meaning, the differences being that now instead of the thermal cracking unit 5, a coking unit 5A is present and that the third vacuum distillation unit 50 is omitted. The processing of the hydrocarbon oil residue 13 obtained by atmospheric distillation takes place in substantially the same way as described under process scheme V, the differences being that now instead of thermal cracking of the mixture 127, coking of the mixture is carried out to form a distillate 228 and coke 234 and that now instead of the vacuum residue 134 of the thermally cracked product, the coke 234 is employed as feed for the gasification unit.

The present patent application also comprises plant for carrying out the process according to the invention as schematically represented in figures I-1-5.

The invention will now be elucidated by reference to the following examples.

The process according to the invention was applied to an atmospheric distillation residue from a crude oil originating from the Middle East. The atmospheric distillation residue had an initial boiling point of 350° C, a sulfur content of 4%*w* and an asphaltenes content of 18%*w* based upon $C_4$ and lighter ($C_4^-$) solvent. The process was carried out according to process schemes I–VI. In the various units the following conditions were employed.

With all process schemes for the catalytic high-pressure hydrotreatment a sulfided cobalt-molybdenum catalyst on alumina as the carrier was employed. When process schemes I and II were used the catalytic high-pressure hydrotreatment took place at an average temperature of 390° C, a hydrogen partial pressure of 100 bar, a space velocity of 0.75 kg oil per liter of catalyst per hour and a hydrogen/oil ratio of 1000 Nl/kg. When process schemes III and IV were used the catalytic high-pressure hydrotreatment took place at an average temperature of 390° C, a hydrogen partial pressure of 100 bar, a space velocity of 0.4 kg oil per liter of catalyst per hour and a hydrogen/oil ratio of 1000 Nl/kg. When process schemes V and VI were used the catalytic high-pressure hydrotreatment took place at an average temperature of 450° C a hydrogen partial pressure of 150 bar, a space velocity of 0.2 kg oil per liter of catalyst per hour and a hydrogen/oil ratio of 1500 Nl/kg.

With all process schemes deasphalting was carried out at 120° C with liquid butane as the solvent and using a solvent/oil weight ratio varying between 3.5:1 and 4.5:1.

When process schemes I, III and V were used thermal cracking was carried out at a pressure of 10 bar, a residence time to 15 minutes and a temperature varying between 450° and 470° C.

When process schemes II, IV and VI were used coking was carried out at a pressure of 3.5 bar, a temperature of 470° C and a residence time varying from 20 to 24 hours.

With all process schemes gasification was carried out at a temperature of 1300° C, a pressure of 30 bar, a steam/feed weight ratio of 0.8:1 and a oxygen/feed weight ratio of 0.81. The water gas shift reaction was carried out in succession in a high temperature zone over an iron-chromium catalyst at a temperature of 350° C and a pressure of 30 bar and in a low temperature zone over a copper-zinc catalyst at a temperature of 250° C and a pressure of 30 bar.

With all process schemes I–VI the catalytic low-pressure hydrotreatment was carried out at a hydrogen partial pressure of 35 bar, a space velocity of 0.5 l oil per l catalyst per hour, a hydrogen/oil ratio of 1000 nl/kg and a temperature varying from 375° to 385° C and using a sulfided nickel-molybdenum catalyst on alumina as the carrier.

With all process schemes catalytic cracking was carried out at a temperature of 490° C, a pressure of 2.2 bar, a space velocity of 2 kg oil per kg catalyst per hour and a catalyst changing rate varying from 0.5 to 1.0 ton of catalyst per 1000 tons of oil and using a zeolite cracking catalyst.

EXAMPLE I

This example was carried out according to process scheme I. Starting from 126 parts by weight of the 350° C+ atmospheric distillation residue 12 the following quantities of the various streams were obtained:

100 parts by weight portion (13A),
26 parts by weight portin (14),
4.1 parts by weight $C_4^-$ fraction (16), 0.9 parts by weight $C_5$-200° C gasoline fraction (17),
5.0 parts by weight 200°-350° C middle distillate fraction (18),
91.3 parts by weight 350° C+ residue (19), 69.8 parts by weight 350°-520° C vacuum distillate (21), 47.5 parts by weight 520° C+ residue (22),
37.0 parts by weight deasphalted oil (23),
10.5 parts by weight asphalt (24),
0.1 parts by weight $C_4$- fraction (26),
0.8 parts by weight $C_5$-200° C gasoline fraction (27),
1.1 parts by weight 200°-350° C middle distillate fraction (28),
8.5 parts by weight 350° C+ residue (29),
1.5 parts by weight 350°-520° C vacuum distillate (30),
7.0 parts by weight 520° C+ residue (31),
1.3 parts by weight hydrogen (32),
18.0 parts by weight 200°-350° C middle distillate fraction (34),
28.0 parts by weight $C_4$- fraction (41),
74.0 parts by weight $C_5$-200° C gasoline fraction 42 and
6.0 parts by weight 350° C+ residue (43).

EXAMPLE II

This example was carried out according to process scheme II. Starting from 148 parts by weight of the 350° C+ atmospheric distillation residue 12 the following quantities of the various streams were obtained:

100 parts by weight portion (13A),
48 parts by weight portion (14),
4.1 parts by weight $C_4$- fraction (16),
0.9 parts by weight $C_5$-200° C gasoline fraction (17),
5.0 parts by weight 200°-350° C middle distillate fraction (18),
91.3 parts by weight 350° C+ residue (19),
79.0 parts by weight 350°-520° vacuum distillate (21),
60.0 parts by weight 520° C+ residue (22),
45.5 parts by weight deasphalted oil (23),
14.5 parts by weight asphalt (24),
6.7 parts by weight distillate (25),
7.8 parts by weight coke (231),
1.8 parts by weight $C_4$-fraction (26),
1.5 parts by weight $C_5$-200° C gasoline fraction (27),
3.4 parts by weight 200°-350° C middle distillate fraction (34),
32.4 parts by weight $C_4$- fraction (41),
83.9 parts by weight $C_5$-200° C gasoline fraction (42) and
7.0 parts by weight 350° C+ residue (43).

EXAMPLE III

This example was carried out according to process scheme III. Starting from 100 parts by weight of the 350° C+ atmospheric distillation residue 13 the following quantities of the various streams were obtained:

44.0 parts by weight 350°-520° C vacuum distillate (64),
56.0 parts by weight 520° C+ residue (65),
41.2 parts by weight portion (66),
14.8 parts by weight portion (67),
2.8 parts by weight $C_4$- fraction (69),
2.3 parts by weight $C_5$-200° C gasoline fraction (70),
5.8 parts by weight 200°-350° C middle distillate fraction (71),
31.4 parts by weight 350° C+ residue (72),
14.5 parts by weight 350°-520° C vacuum distillate (73),
16.9 parts by weight 520° C residue (74),
23.4 parts by weight deasphalted oil (76),
8.3 parts by weight asphalt (77),
0.1 parts by weight $C_4$- fraction (79),
0.6 parts by weight $C_5$-200° C gasoline fraction (80),
0.8 parts by weight 200°-350° middle distillate fraction (81),
6.8 parts by weight 350° C+ residue (82),
1.1 parts by weight hydrogen (85),
14.6 parts by weight 200°-350° C middle distillate fraction (87),
21.9 parts by weight $C_4$- fraction (94),
56.5 parts by weight $C_5$-200° C gasoline fraction (95) and
4.9 parts by weight 350° C+ residue (96).

EXAMPLE IV

This example was carried out according to process scheme IV. Starting from 100 parts by weight of the 350° C+ atmospheric distillation residue 13 the following quantities of the various streams were obtained:
44.0 parts by weight 350°-520° C vacuum distillate (64),
56.0 parts by weight 520° C+ residue (65),
34.0 parts by weight portion (66),
22.0 parts by weight portion (67),
2.2 parts by weight $C_4$- fraction (69),
1.9 parts by weight $C_5$-200° C gasoline fraction (70),
4.8 parts by weight 200°-350° C middle distillate fraction (71),
25.9 parts by weight 350° C+ residue (72),
12.0 parts by weight 350°-520° C vacuum distillate (73),
13.9 parts by weight 520° C+ residue (74),
26.5 parts by weight deasphalted oil (76),
9.4 parts by weight asphalt (77),
4.3 parts by weight distillate (278),
5.1 parts by weight coke (84A)
1.1 parts by weight $C_4$+ fraction (79),
1.0 parts by weight $C_5$-200° C gasoline fraction (80),
2.2 parts by weight 200°-350° C middle distillate fraction (81),
0.8 parts by weight hydrogen (85),
14.5 parts by weight 200°-350° C middle distillate fraction (87),
21.8 parts by weight $C_4$- fraction (94),
56.5 parts by weight $C_5$-200° C gasoline fraction (95), and
4.9 parts by weight 350° C+ residue (96).

EXAMPLE V

This example was carried out according to process scheme V. Starting from 100 parts by weight of the 350° C+ atmospheric distillation residue 13 the following quantities of the various streams were obtained:

44.0 parts by weight 350°-520° C vacuum distillate (114),
56.0 parts by weight 520° C+ residue (115),
33.0 parts by weight deasphalted oil (116),
23.0 parts by weight asphalt (117),
19.0 parts by weight portion (118),
4.0 parts by weight portion (119),
2.5 parts by weight $C_4$- fraction (121),
1.7 parts by weight $C_5$-200° C gasoline fraction (122),
7.5 parts by weight 200°-350° C middle distillate fraction (123),
8.3 parts by weight 350° c+ residue (124),
4.3 parts by weight 350°-520° C vacuum distillate (125),
4.0 parts by weight 520° C+ residue (126),
0.1 parts by weight $C_4$-fraction (129),
0.6 parts by weight $C_5$-200° C gasoline fraction (130), 0.8 parts by weight 200°-350° C middle distillate fraction (131),
6.5 parts by weight 350° C+ residue (132),
1.5 parts by weight 350°-520° C vacuum distillate 133,
5.0 parts by weight 520° C+ residue (134),
1.0 parts by weight hydrogen (135),
14.6 parts by weight 200°-300° C middle distillate fraction (137),
22.2 parts by weight $C_4$- fraction (144),
57.5 parts by weight $C_5$-200° C gasoline fraction (145) and
4.9 parts by weight 350° C+ residue (146).

EXAMPLE VI

This example was carried out according to process scheme VI. Starting from 100 parts by weight of the 350° C+ atmospheric distillation residue 13 the following quantities of the various streams were obtained.

44.0 parts by weight 350°-520° C vacuum distillate (114),
56.0 parts by weight 520° C+ residue (115),
33.0 parts by weight deasphalted oil (116),
23.0 parts by weight asphalt (117),
15.0 parts by weight portion (118),
8.0 parts by weight portion (119),
2.0 parts by weight $C_4$- fraction (121),
1.4 parts by weight $C_5$-200° C gasoline fraction (122),
6.5 part by weight 200°-350° C middle distillate fraction (123),
5.8 parts by weight 350° C+ residue (124),
3.0 parts by weight 350°-520° C vacuum distillate (125),
2.8 parts by weight 520° C+ residue (126),
6.6 parts by weight distillate (228),
4.2 parts by weight coke (234),
1.4 parts by weight $C_4$- fraction (129),
1.3 parts by weight $C_5$-200° C gasoline fraction (130),
3.9 parts by weight 200°-350° C middle distillate fraction (131),
0.7 parts by weight hydrogen (135),
14.5 parts by weight 200°-350° C middle distillate fraction (137),
22.1 parts by weight $C_4$- fraction (144),
57.0 parts by weight $C_5$-200° C gasoline fraction (145) and
4.8 parts by weight 350° C+ residue (146).

What is claimed is:

1. A process for the production of light hydrocarbon distillates from a hydrocarbon oil residue obtained by atmospheric distillation which comprises:

a. fractionating said residue by vacuum distillation into a vacuum distillate and a vacuum residue;
b. deasphalting said vacuum residue in a deasphalting zone by contact with a low boiling hydrocarbon sorbent to obtain a deasphalted oil and asphalt;
c. catalytically cracking said vacuum distillate and said deasphalted oil in a catalytic cracking zone to obtain a catalytically cracked product;
d. fractionating said catalytically cracked product by fractionation distillation at essentially atmospheric pressure to obtain at least one light hydrocarbon distillate product; an intermediate boiling fraction and a residue;
e. hydrotreating said intermediate boiling fraction in a low pressure hydrotreating zone and recycling at least part of said intermediate fraction to said catalytic cracking zone;
f. thermally heating at least one of said asphalt and said residue in thermal treatment zone comprising either a thermal cracking zone or a coking zone to obtain a thermal treatment product;
g. fractionating said thermal product by fractionation distillation into at least one light distillate product, a thermal intermediate fraction and a thermal residue;
h. hydrotreating said thermal intermediate fraction in a low pressure hydrotreating zone and recycling at least part of this hydrotreated product as feed to the catalytic cracking zone;
i. gasifying the thermal residual fraction in a gasification zone and catalytically reacting said gasified product with steam to produce hydrogen;
j. feeding said hydrogen to a high pressure catalytic hydrotreating zone together with at least part of the atmospheric distillation residue feed prior to step (a) or to at least part of the vacuum residue feed to step (b); then
k. passing said hydrogen exiting said high pressure hydrotreating zone as feed to a low pressure catalytic hydrotreating zone together with a feed selected from the vacuum distillate product of step (a) and at least part of the asphalt product of step (b); and then
l. passing said hydrogen exiting step (k) to at least one low pressure catalytic hydrotreating zone selected from steps (e) and (h).

2. A process according to claim 1 wherein in step (c) the catalytic cracking is carried out using a zeolite catalyst at a temperature of from 400° to 550° C, a pressure of from 1 to 10 bar, a space velocity of from 0.25 to 4 $kg.kg^{-1}$ $hour^{-1}$ and a catalyst changing rate of from 0.1 to 5 tons of catalyst per 1000 tons of feed.

3. A process according to claim 1 wherein the hydrogen partial pressure applied in the catalytic high-pressure hydrotreating zone is at least 50 bar higher than the hydrogen partial pressure in the low-pressure hydrotreating zone.

4. A process according to claim 1 wherein the catalytic high-pressure hydrotreatment is carried out using a sulfided catalyst which contains at least one of nickel and cobalt and in addition at least one of molybdenum and tungsten on a carrier selected from alumina, silica and silica-alumina, at a temperature of from about 325° to 500° C, a hydrogen partial pressure of from 90 to 175 bar, a space velocity of from 0.1 to 2.5 $l.l^{-1}.hour^{-1}$ and a hydrogen/feed ratio of from 250 to 3000 $Nl.kg^{-1}$.

5. A process according to claim 1 wherein in steps (e) and (h) the catalytic low pressure hydrotreatment is carried out using a sulfided catalysts which contains at least one of nickel and cobalt and in addition at least one of molybdenum and tungsten on a carrier selected from alumina, silica or silica-alumina, at a temperature of from about 275° to 425° C, a hydrogen partial pressure of from 20 to 75 bar, a space velocity of from 0.1-5 $l.l^{-1}.hour^{-1}$ and a hydrogen/feed ratio of from 100 to 2000 $Nl.kg^{-1}$.

6. A process according to claim 1 wherein in step (j) the feed to catalytic high-pressure hydrotreatment is at least part of the asphalt obtained from step (b) and comprising the further steps of fractionating the hydrotreated product of step (j) by fractionation distillation at essentially atmospheric pressure to obtain an least one light hydrocarbon distillate product, a middle distillate fraction and an atmospheric residue, passing said middle distillate fraction as a feed component to the catalytic cracking zone of step (c), deasphalting said atmospheric residue in the deasphalting zone of step (b), to obtain a deasphalted oil and an asphalt;

passing said deasphalted oil to a feed component to the catalytic cracking zone of step (c), and passing the asphalt to the thermal treatment zone of step (f).

7. A process according to claim 1 wherein in step (f) the thermal treatment comprises thermal cracking carried out at a temperature of from 400° to 525° C, a pressure of from 2.5 to 25 bar and a residence time of from 1 to 25 minutes.

8. A process according to claim 1 wherein in step (f) the thermal treatment comprises coking carried out at a temperature of from 400° to 600° C a pressure of from 1 to 25 bar and a residence time of from 5 to 50 hours.

9. A process according to claim 1 wherein in step (i) the gasification is carried out by incomplete combustion of the feed with air and in the presence of steam as moderator, the hydrogen content of the crude gas which consists substantially of carbon monoxide and hydrogen is increased by contacting the crude gas together with 1–50 mol steam per mol carbon monoxide at a pressure of from 10 to 100 bar is succession in a first zone with a high-temperature water gas shift catalyst at a temperature from 325° to 400° C and then in a second zone with a low-temperature water gas shift catalyst at a temperature from 200° to 275° C followed by purification of the hydrogen-rich gas thus obtained.

10. A process according to claim 1 wherein at least one of (1) part of the intermediate boiling fraction product of step (d) and (2) at least part of the residue product of step (d) are passed as a feed component to the coking zone of step (f) or to the gasification zone of step (i).

11. A process according to claim 1 wherein part of the intermediate boiling fraction product of step (d) is passed as a feed component to the thermal cracking zone of step (f).

* * * * *